US006471552B2

(12) United States Patent
Bechaz et al.

(10) Patent No.: US 6,471,552 B2
(45) Date of Patent: Oct. 29, 2002

(54) SPRING FOR SECURING A TERMINAL BLOCK OR THE LIKE TO A RAIL

(75) Inventors: Bernard Bechaz, Caluire (FR); Philippe Dubech, Rillieux-la-Pape (FR)

(73) Assignee: Entrelec S.A., Lyons (FR)

( * ) Notice: Subject to any disclaimer, the term of this patent is extended or adjusted under 35 U.S.C. 154(b) by 0 days.

(21) Appl. No.: 09/739,017

(22) Filed: Dec. 19, 2000

(65) Prior Publication Data

US 2001/0051466 A1 Dec. 13, 2001

(30) Foreign Application Priority Data

Jan. 4, 2000 (FR) ..... 00 00067

(51) Int. Cl.[7] ..... H01R 9/26

(52) U.S. Cl. ..... 439/716; 267/160; 267/53; 439/816

(58) Field of Search ..... 439/716, 721, 439/835, 828, 816; 267/160, 159, 158, 47, 53

(56) References Cited

U.S. PATENT DOCUMENTS

| | | | | |
|---|---|---|---|---|
| 4,058,157 A | * | 11/1977 | Wiegard | 267/160 |
| 5,049,094 A | * | 9/1991 | Heng et al. | 439/94 |
| 5,362,259 A | * | 11/1994 | Bolliger | 439/716 |
| 5,890,916 A | | 4/1999 | Dickmann et al. | 439/94 |
| 6,146,186 A | * | 11/2000 | Barrat et al. | 439/835 |

FOREIGN PATENT DOCUMENTS

| | | |
|---|---|---|
| DE | 197 08 912 C1 | 6/1998 |
| EP | 0 233 458 A1 | 8/1987 |
| EP | 0 863 577 A2 | 9/1998 |

OTHER PUBLICATIONS

Merriam Webster's Collegiate Dictionary 10th Edition.*

* cited by examiner

*Primary Examiner*—Renee Luebke
*Assistant Examiner*—Briggitte R. Hammond
(74) *Attorney, Agent, or Firm*—Oliff & Berridge, PLC

(57) ABSTRACT

This spring is made from a metal leaf.

On one edge it has at least one tab bent toward the terminal block and intended to sit beside the bonding leg.

33 Claims, 2 Drawing Sheets

SPRING FOR SECURING A TERMINAL BLOCK OR THE LIKE TO A RAIL

BACKGROUND OF THE INVENTION AND DESCRIPTION OF THE PRIOR ART

The present invention relates to a spring for securing a terminal block or the like to a rail.

This invention relates more particularly to the securing to a rail of a terminal block equipped with a bonding leg. A terminal block such as this comprises an insulated housing in which two or more connection terminals joined together by a connecting strip are placed. A bonding leg electrically connects the connecting strip to the rail on which the terminal block is mounted. In the event of a short circuit, the bonding leg is to allow the passage of a strong current toward the support rail. Standards anticipate the passage of a current of 120 A per $mm^2$ that can be applied to the terminal block for one second. It is therefore necessary to ensure excellent contact between the bonding leg and the support rail.

SUMMARY OF THE INVENTION

The object of the present invention is therefore to provide a spring which ensures good contact between a bonding leg and a support rail intended to take this contact leg. Advantageously, this spring will be easy to fit and of low cost.

To this end, the present invention proposes a spring of the type of spring for securing a terminal block comprising a bonding leg to a support rail, and made from a metal leaf.

According to the invention, this spring on one edge has at least one tab bent toward the terminal block and intended to sit beside the bonding leg.

Thus, the spring is held correctly in place while it is being positioned on the bonding leg and while the terminal block is being positioned on the support rail. As the spring is always correctly positioned, it is possible to be sure that it will exert pressure from the connecting leg on to the support rail, as intended.

In a preferred embodiment, the tab, of which there is at least one, is made by cutting longitudinally into one end or the metal leaf then bending upward.

In order to ensure that the spring is correctly held in place, it advantageously comprises two tabs, one at each of its ends, the two tabs being on one and the same edge.

In one embodiment, the spring comprises a bowed part intended to bear against the underside of the bonding leg, and a bent end intended to be housed in a housing designed for this purpose in the bonding leg, an elastic curved part connecting the bowed part and the bent end.

The present invention also relates to a terminal block comprising a bonding leg and a spring for securing it to a support rail, wherein the securing spring is a spring as described hereinabove.

BRIEF DESCRIPTION OF THE DRAWINGS

In any case, the invention will be clearly understood with the aid of the description which follows, with reference to the appended diagrammatic drawing which, by way of nonlimiting example, depicts one preferred embodiment of a spring according to the invention.

DESCRIPTION OF THE PREFERRED EMBODIMENT

Figure 1:
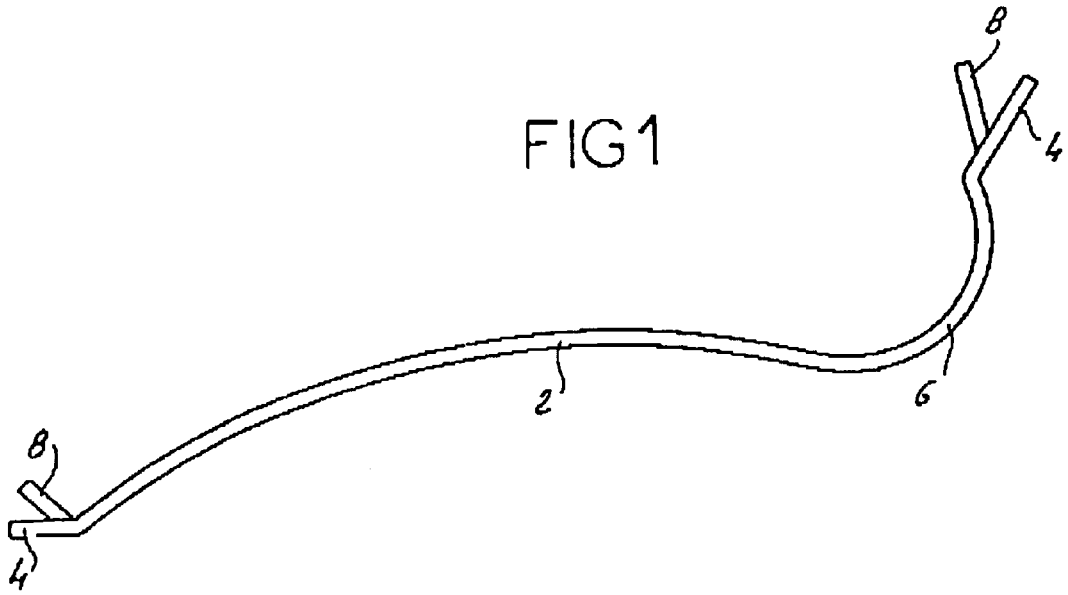
FIG. 1 is a side view of a spring according to the invention.
Figure 2:
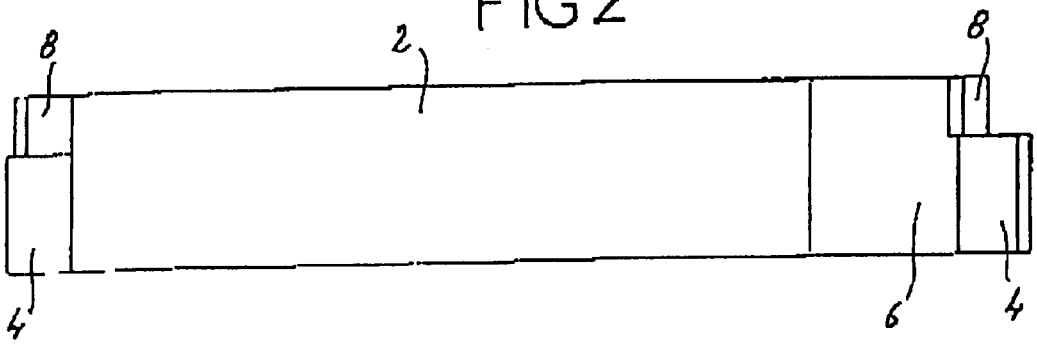
FIG. 2 is a view from above of the spring of FIG. 1.

FIGS. 1 and 2 show a side view and a view from above, respectively, of a spring according to the invention. This spring is obtained from a metal leaf, cut then bent to obtain the spring depicted in these figures.

The spring has a bowed part 2, a bent end 4, an elastic zone 6 connecting the bent end 4 and the bowed part 2, and two tabs 8 bent upward. The elastic zone 6 is a curved zone curved in the opposite direction to the bowed part 2 so that there is a point of inflection between these two parts of the spring.

To make the tabs 8, two longitudinal cuts have been made in the metal leaf at the ends thereof. These two cuts have been made about one third of the way across the width of the metal leaf. The tabs 8 thus have a width which roughly corresponds to one third of the width of the metal leaf. These two tabs 8 are both made on one and the sane edge of the spring. To make these tabs, a transverse fold has been made at the base of the cut.

Figure 3:
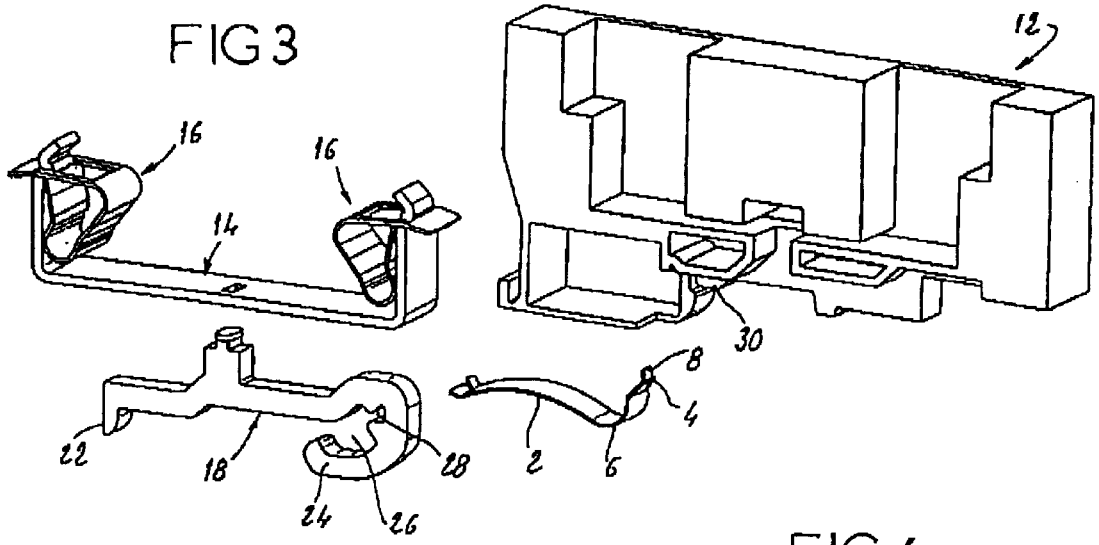
FIG. 3 is a view in exploded perspective of a terminal block equipped with a spring according to the invention.
Figure 4:
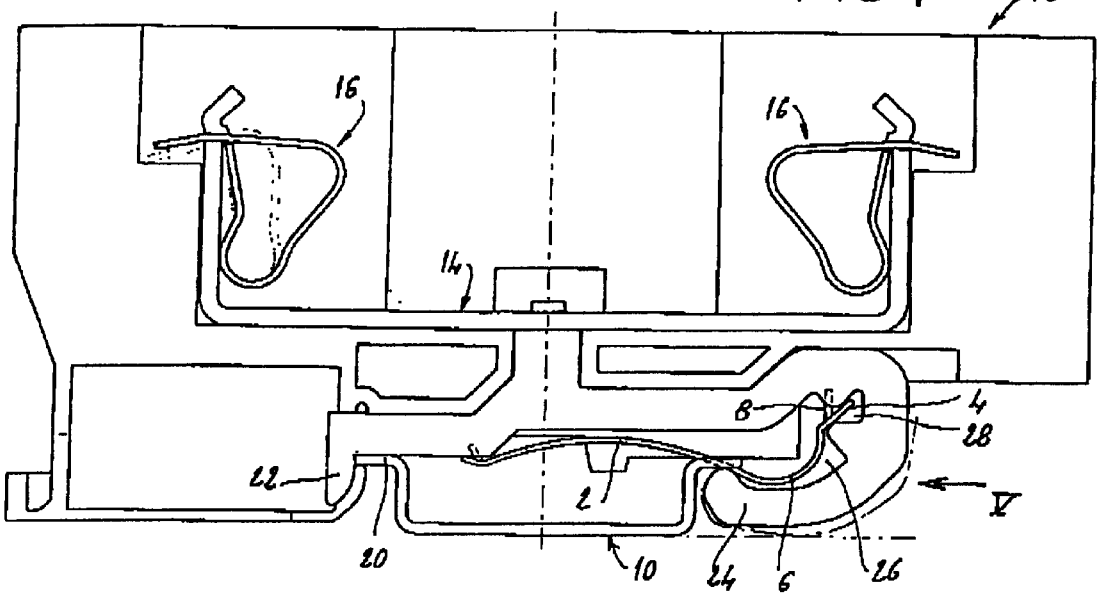
FIG. 4 is a front view on a larger scale of the terminal block of FIG. 3.
Figure 5:
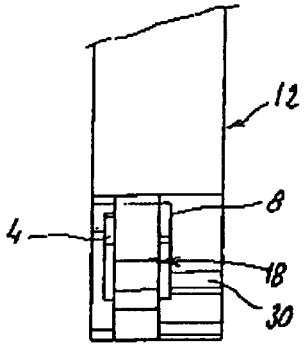
FIG. 5 is a view on arrow V of FIG. 4, of the bottom of the terminal block of FIG. 4.

FIGS. 3 to 5 show the spring of FIGS. 1 and 2 in conjunction with a terminal block intended to be mounted on a support rail 10. The terminal block in the known way comprises an insulating housing 12, a connecting strip 14, two connecting devices 16, a bonding leg 18 and the spring of FIGS. 1 and 2. The connecting strip connects the two connecting devices 16. These are spring devices. Of course, any other connection device could be used here. The bonding leg 18 is intended to provide an electrical connection between the connecting strip 14 and the support rail 10 when the terminal block is fixed to the latter. The spring is intended to provide good electrical contact between the bonding leg 18 and the support rail 10 by pressing the leg 18 onto the rail 10.

The support rail 10 is a profiled rail commonly used for mounting terminal blocks. It has a U-shaped section, the ends of the branches of the U having been bent outward at right angles to thus form two lateral flanges 20. The cross section of the profiled rail 10 therefore has a shape reminiscent of that of a hat.

The bonding leg 18 rests on the two flanges 20 of the support rail 10. In the known way, it has a stop 22 intended to butt laterally against a flange 20 of the support rail 10. On the opposite side to the stop, the bonding leg has a branch 24 intended to grip a lateral flange 20 of the support rail 10 from underneath. On the same side as the branch 24, the bonding leg has a housing 26 intended to accommodate the spring of FIGS. 1 and 2. The shape of this housing 26 is designed in particular to immobilize the bent end 4 of the spring. A cavity 28 is provided in the bonding leg 18 for this purpose.

When the spring is mounted on the bonding leg 18, the bent end 4 becomes housed in the cavity 28, the bowed part bears against the underside of the bonding leg 18 and the elastic zone 6 positions itself at the branch 24. The tabs 8 rest against a lateral face of the bonding leg 18 as can be seen in FIG. 5. A wall 30 is provided in the housing 12 so that the tab 8 on the same side as the bowed part 2 is sandwiched between the bonding leg 18 and the wall 30 when the terminal block is in the fitted position. Thus, the spring is kept against this bonding leg 18 and cannot move in a longitudinal direction with respect to the support rail 10. In the transverse direction with respect to the support rail 10, the spring is also immobilized in terms of translation, particularly at the cavity 28.

By virtue of the fact that the spring is correctly positioned with respect to the bonding leg, it is possible to make sure, when fitting the terminal block on the support rail 10, that good contact pressure is exerted between the bonding leg 18 and the rail 10. During any movement of the terminal block on the support rail 10 that might occur, the spring is correctly held in place and continues to exert the pressure needed to ensure a good electrical contact.

As goes without saying, the invention is not restricted to the embodiment described hereinabove by way of nonlimiting example; on the contrary, it encompasses all variations thereon.

Thus, the invention could be implemented with a spring which has a shape other than the one described hereinabove and shown in the drawing. As is clear from the foregoing, the invention is, however, more particularly suited to a spring made from an elastic metal leaf.

The terminal block described hereinabove is given by way of example. The number of connections, the type of connections used (sprung) the shape of the connecting strip, the position of the inlets for the wires that are to be connected, are given by way of example and no limitation should be implied thereby.

What is claimed is:

1. A spring for securing a bonding leg of a terminal block to a support rail, the spring being made from a metal leaf comprising:

a first end defining a first plane and a second end defining a second plane;

two longitudinal edges;

an upward face intended to bear at least partly against the bonding leg; and a downward face intended to bear at least partly on the support rail, wherein the spring comprises on one longitudinal edge a portion of the first end which is bent to form a first tab which lies in a different plane than the first plane.

2. The spring as claimed in claim 1, wherein a width of the first tab is less than a width of the metal leaf.

3. The spring as claimed in claim 2, wherein the width of the first tab corresponds to about one third of the width of the metal leaf.

4. The spring as claimed in claim 1, comprising a bowed part, a bent end and an elastic curved part connecting the bowed part and the bent end.

5. The spring as claimed in claim 4, wherein the elastic part is curved in an opposite direction to the bowed part so that there is a point of inflection between the elastic part and the bowed part of the spring.

6. The spring as claimed in claim 5, wherein a bending radius of the elastic part is smaller than a bending radius of bowed part.

7. The spring as claimed in claim 1, wherein the first tab is made by cutting longitudinally into the first end of the metal leaf then bending upward.

8. The spring as claimed in claim 7, wherein the first tab has a width which corresponds to about one third of a width of the metal leaf.

9. The spring as claimed in claim 7, further comprising a portion of the second end which is bent to form a second tab which lies in a different plane than the second plane, the first and second tabs being on a same longitudinal edge of the spring.

10. The spring as claimed in claim 7, comprising a bowed part, a bent end and an elastic curved part connecting the bowed part and the bent end.

11. The spring as claimed in claim 10, wherein the elastic part is curved in an opposite direction to the bowed part so that there is a point of inflection between the elastic part and the bowed part of the spring.

12. The spring as claimed in claim 11, wherein a bending radius of the elastic part is smaller than a bending radius of bowed part.

13. The spring as claimed in claim 1, further comprising a portion of the second end which is bent to form a second tab which lies in a different plane than the second plane, the first and second tabs being on a same longitudinal edge of the spring.

14. The spring as claimed in claim 13, wherein each tab has a width which corresponds to about one third of a width of the metal leaf.

15. The spring as claimed in claim 13, wherein each tab is made by cutting longitudinally into a respective end of the metal leaf then bending upward.

16. The spring as claimed in claim 13, comprising a bowed part, a bent end and an elastic curved part connecting the bowed part and the bent end.

17. The spring as claimed in claim 16, wherein the elastic part is curved in an opposite direction to the bowed part so that there is a point of inflection between the elastic part and the bowed part of the spring.

18. The spring as claimed in claim 17, wherein a bending radius of the elastic part is smaller than a bending radius of bowed part.

19. A terminal block comprising an insulating housing, a bonding leg and a spring for securing the bonding leg of the terminal block to a support rail, wherein the securing spring is made from a metal leaf and comprises:

a first end defining a first plane and a second end defining a second plane;

two longitudinal edges;

an upward or inner face bearing at least partly against the bonding leg; and a downward or outer face intended to bear at least partly on the support rail, wherein the spring comprises on one longitudinal edge a portion of the first end which is bent to form a first tab which lies in a different plane than the first plane, the first tab resting against a lateral face of the bonding leg.

20. The terminal block as claimed in claim 19, wherein the insulating housing comprises a wall which sandwiches the first tab between the bonding leg and the wall.

21. The terminal block as claimed in claim 19, wherein the first tab of the spring is made by cutting longitudinally into the first end of the metal leaf then bending upward.

22. The terminal block as claimed in claim 21, wherein the first tab of the spring has a width which is less than a width of the metal leaf.

23. The terminal block as claimed in claim 22, wherein the width of the first tab corresponds to about one third of the width of the metal leaf.

24. The terminal block as claimed in claim 19, wherein:

the spring comprises a bowed part bearing against an under side of the bonding leg, a bent end and an elastic curved part connecting the bowed part and the bent end, and the bonding leg comprises a stop intended to butt against the support rail and on an opposite side to the stop a gripping branch intended to grip the support rail, the gripping branch delimiting an housing accommodating the elastic part of the spring and an immobilizing cavity receiving the bent end of the spring.

25. The terminal block as claimed in claim 24, wherein the elastic part of the spring is curved in an opposite direction to the bowed part of the spring so that there is a point of inflection between the elastic part and the bowed part of the spring.

26. The terminal block as claimed in claim 25, wherein a bending radius of the elastic part of the spring is smaller than a bending radius of the bowed part of the spring.

27. The terminal block as claimed in claim 19, wherein the spring further comprises a portion of the second end which is bent to form a second tab which lies in a different plane than the second plane, the first and second tabs being on a same longitudinal edge of the spring and resting against a same lateral face of the bonding leg.

28. The terminal block as claimed in claim 27, wherein each tab of the spring is made by cutting longitudinally into a respective end of the metal leaf then bending upward.

29. The terminal block as claimed in claim 27, wherein each tab has a width which corresponds to about one third of a width of the metal leaf.

30. The terminal block as claimed in claim 27, wherein:

the spring comprises a bowed part bearing against an under side of the bonding leg, a bent end and an elastic curved part connecting the bowed part and the bent end, one of the first and second tabs being on a side of the bowed part and the other of the first and second tabs being on a side of the bent end, and the bonding leg comprises a stop intended to butt against the support rail and on an opposite side to the stop a gripping branch intended to grip the support rail, the gripping branch delimiting an housing accommodating the elastic part of the spring and an immobilizing cavity receiving the bent end of the spring.

31. The terminal block as claimed in claim 27, wherein the elastic part of the spring is curved in an opposite direction to the bowed part of the spring so that there is a point of inflection between the elastic part and the bowed part of the spring.

32. The terminal block as claimed in claim 27, wherein a bending radius of the elastic part of the spring is smaller than a bending radius of the bowed part of the spring.

33. The terminal block as claimed in claim 27, wherein the insulating housing comprises a wall which sandwiches the one of the first and second tabs being on a side of the bowed end between the bonding leg and the wall.

* * * * *